US008412393B2

(12) United States Patent
Anderson et al.

(10) Patent No.: US 8,412,393 B2
(45) Date of Patent: Apr. 2, 2013

(54) APPARATUS AND METHOD FOR MONITORING OF INFRASTRUCTURE CONDITION

(75) Inventors: Todd Alan Anderson, Niskayuna, NY (US); Nelson Corby, Scotia, NY (US); Harry Kirk Mathews, Jr., Clifton Park, NY (US); Minesh Shah, Clifton Park, NY (US); Thomas Sebastian, Flemington, NJ (US)

(73) Assignee: General Electric Company, Niskayuna, NY (US)

( * ) Notice: Subject to any disclaimer, the term of this patent is extended or adjusted under 35 U.S.C. 154(b) by 1119 days.

(21) Appl. No.: 12/243,112

(22) Filed: Oct. 1, 2008

(65) Prior Publication Data

US 2010/0004804 A1 Jan. 7, 2010

Related U.S. Application Data

(60) Provisional application No. 61/077,383, filed on Jul. 1, 2008.

(51) Int. Cl.

| | |
|---|---|
| ***B61L 23/04*** | (2006.01) |
| ***G08G 1/123*** | (2006.01) |
| ***G05D 1/00*** | (2006.01) |
| ***G06F 17/00*** | (2006.01) |
| ***G01M 17/08*** | (2006.01) |

(52) U.S. Cl. ..... 701/19; 701/29.1; 701/32.1; 701/32.4; 701/409; 246/121; 340/989; 340/995.18

(58) Field of Classification Search ..... 701/1, 19, 701/20, 200, 207, 208, 213, 300, 29.1, 29.3, 701/29.4, 32.1, 32.3, 32.4, 33.4, 400, 408, 701/409, 468, 484, 521, 532; 246/20, 27, 246/115, 117, 119–122, 119–122 R; 340/988, 340/989, 995.14, 995.18

See application file for complete search history.

(56) References Cited

U.S. PATENT DOCUMENTS

| | | | | |
|---|---|---|---|---|
| 5,398,894 | A * | 3/1995 | Pascoe | 246/28 R |
| 5,740,547 | A * | 4/1998 | Kull et al. | 701/19 |
| 5,978,717 | A * | 11/1999 | Ebersohn et al. | 701/19 |
| 5,978,718 | A * | 11/1999 | Kull | 701/19 |
| 6,262,573 | B1 | 7/2001 | Wojnarowski et al. | |

(Continued)

FOREIGN PATENT DOCUMENTS

EP 1236634 A1 9/2002

OTHER PUBLICATIONS

"Automated Joint Bar Inspection System," Transportation Track Inspection, Ensco, Inc., Springfield, VA.

(Continued)

*Primary Examiner* — Thomas Tarcza
*Assistant Examiner* — Edward Pipala
(74) *Attorney, Agent, or Firm* — Joseph J. Christian

(57) ABSTRACT

A system and method for vehicle-centric infrastructure monitoring system includes an inspection system mountable on a vehicle configured to travel over an expanse of rail track having a plurality of track blocks. The inspection system acquires track data for at least some track blocks along the expanse of rail track. The monitoring system also includes a positioning system to determine a location of the vehicle and generate location data indicative of an associated track block location, a communications device to transmit the track/location data to a remote location, and a centralized computing system positioned at the remote location to receive the transmitted track/location data. The centralized computing system is programmed to determine a current probability of a track condition for a track block and combine the current track condition probability with a previously determined cumulative track condition probability to provide an updated track condition probability for the track block.

25 Claims, 3 Drawing Sheets

U.S. PATENT DOCUMENTS

| | | | | |
|---|---|---|---|---|
| 6,347,265 | B1 | 2/2002 | Bidaud | |
| 6,532,038 | B1 * | 3/2003 | Haring et al. | 348/148 |
| 6,570,497 | B2 | 5/2003 | Puckette, IV et al. | |
| 6,668,239 | B1 | 12/2003 | Gilbert et al. | |
| 6,681,160 | B2 | 1/2004 | Bidaud | |
| 7,164,975 | B2 | 1/2007 | Bidaud | |
| 7,680,631 | B2 * | 3/2010 | Selig et al. | 702/189 |
| 2006/0098843 | A1 | 5/2006 | Chew | |
| 2007/0216771 | A1 * | 9/2007 | Kumar | 348/148 |

OTHER PUBLICATIONS

Esveld, "Modern Railway Track," MRT, 2001.

* cited by examiner

APPARATUS AND METHOD FOR MONITORING OF INFRASTRUCTURE CONDITION

CROSS-REFERENCE TO RELATED APPLICATION

The present application is a non-provisional of, and claims priority to, U.S. Provisional Application Ser. No. 61/077,383, filed Jul. 1, 2008.

BACKGROUND

1. Technical Field

The present disclosure relates to transportation infrastructure generally, and more particularly, to methods and systems for vehicle-centric infrastructure monitoring and system optimization.

2. Discussion of Art

It is recognized in the transportation industry that it is desirable to acquire and analyze data regarding the condition of infrastructure, such as a railway infrastructure for example. Current systems for monitoring the condition of infrastructure are directed to one of two possible approaches. The first approach for monitoring the condition of the railway infrastructure involves collecting large amounts of data infrequently. That is, a specialized railway inspection vehicle is used to acquire track condition data during a single pass over a plurality of sections of the railway infrastructure. There are several drawbacks to such a manner for acquiring and analyzing data regarding the condition of railway infrastructure. First, given the large number of track miles and the relatively few inspection vehicles that a railway operator can afford, the time required to acquire and analyze data for the entire infrastructure (i.e., get 100% coverage) can be quite large. Additionally, as these inspection vehicles are typically slow traveling in order to acquire all data in a single pass, data acquisition can be even further prolonged.

An additional approach for monitoring the condition of the railway infrastructure involves acquiring and processing all information on an in service vehicle, such as a train, as it travels on the railway infrastructure. The train acquires track condition data during a single pass as it traverses portions of the railway infrastructure and analyzes the data in near real-time to thus assess the condition of that part of the railway infrastructure. As the train only acquires data in a single pass and analyzes the data thereon, data regarding the condition of the railway infrastructure is thus again limited to a single acquisition of data.

As data on the condition of the railway infrastructure would ideally be acquired and analyzed on a regular basis, such that the condition of the railway infrastructure can be updated on a regular basis and be as current as possible, it is desirable that data on the condition of the railway infrastructure be obtained more frequently. As set forth above, given the large number of track miles and the overall size of the railway infrastructure, the time required to acquire and analyze data for the entire infrastructure via the single pass methods described above can be quite large. Furthermore, due to time and cost constraints of data acquisition and data communication bandwidth, railroads are precluded from having a more frequent assessment of infrastructure/asset condition via such single-pass methods.

It would therefore be desirable to have a system and method capable of acquiring and analyzing data regarding the condition of the railway infrastructure in a more efficient manner. It would further be desirable for such a system and method to acquire the data on a more frequent basis and by way of multiple passes and analyze the data acquired in each pass to determine an updated condition of the railway infrastructure. Also, to achieve more frequent inspection by a large number of inspection systems, it would be further desirable to have the system be of low cost

BRIEF DESCRIPTION

In accordance with one aspect of the invention, a monitoring system includes an inspection system mountable on a vehicle that is configured to travel over an expanse of rail track, the rail track having a plurality of track blocks, and the inspection system configured to acquire track data for at least some track blocks along the expanse of rail track. The monitoring system also includes a positioning system mountable on the vehicle and configured to determine a location of the vehicle on the expanse of rail track and generate location data indicative of the track block associated with that vehicle location, a communications device connected to the inspection system and to the positioning system to transmit the track data and the position data to a remote location, and a centralized computing system positioned at the remote location to receive the transmitted track data and location data. The centralized computing system is programmed to determine a current probability of a track condition for a track block based on the track data and combine the current track condition probability for the track block with a previously determined cumulative track condition probability for the track block to provide an updated track condition probability for the track block.

In accordance with one aspect of the invention, a method includes the steps of acquiring track data and position data during a current pass of a vehicle over an expanse of rail track and transmitting the track data and the position data to a remotely located centralized database. The method also includes the steps of determining a location-indexed track condition of the expanse of rail track at the remotely located centralized database based on the processed track data and the processed position data acquired from the current pass, and combining the determined location-indexed track condition of the expanse of rail track from the current pass with a location-indexed track condition of the expanse of rail track determined from track data and condition data acquired from at least one previous pass of the vehicle over the expanse of rail track to determine an aggregate location-indexed track condition of the expanse of rail track.

In accordance with one aspect of the invention, a method includes the steps of performing a series of passes of a vehicle over an expanse of track, acquiring track data for a plurality of discrete locations along the expanse of railroad track from the series of passes, and acquiring position data for the plurality of discrete locations along the expanse of railroad track from the series of passes. The method also includes the steps of location-indexing the track data to the discrete locations based on the position data and, during each pass in the series of passes, transmitting the location-indexed track data to a remotely located centralized database. The method further includes the steps of determining at the centralized database, for each pass in the series of passes, a track condition probability for each of the plurality of discrete locations based on the location-indexed track data, combining the track condition probabilities from each pass in the series of passes for each of the plurality of discrete locations to determine a final track condition probability for each of the plurality of discrete locations, and determining a control strategy for a future pass of the vehicle along the expanse of rail track based on the final track condition probability for each of the plurality of discrete locations.

Various other features and advantages will be made apparent from the following detailed description and the drawings.

BRIEF DESCRIPTION OF THE DRAWINGS

The drawings illustrate embodiments presently contemplated for carrying out the invention.

In the drawings.

DETAILED DESCRIPTION OF THE PREFERRED EMBODIMENT

Figure 1:
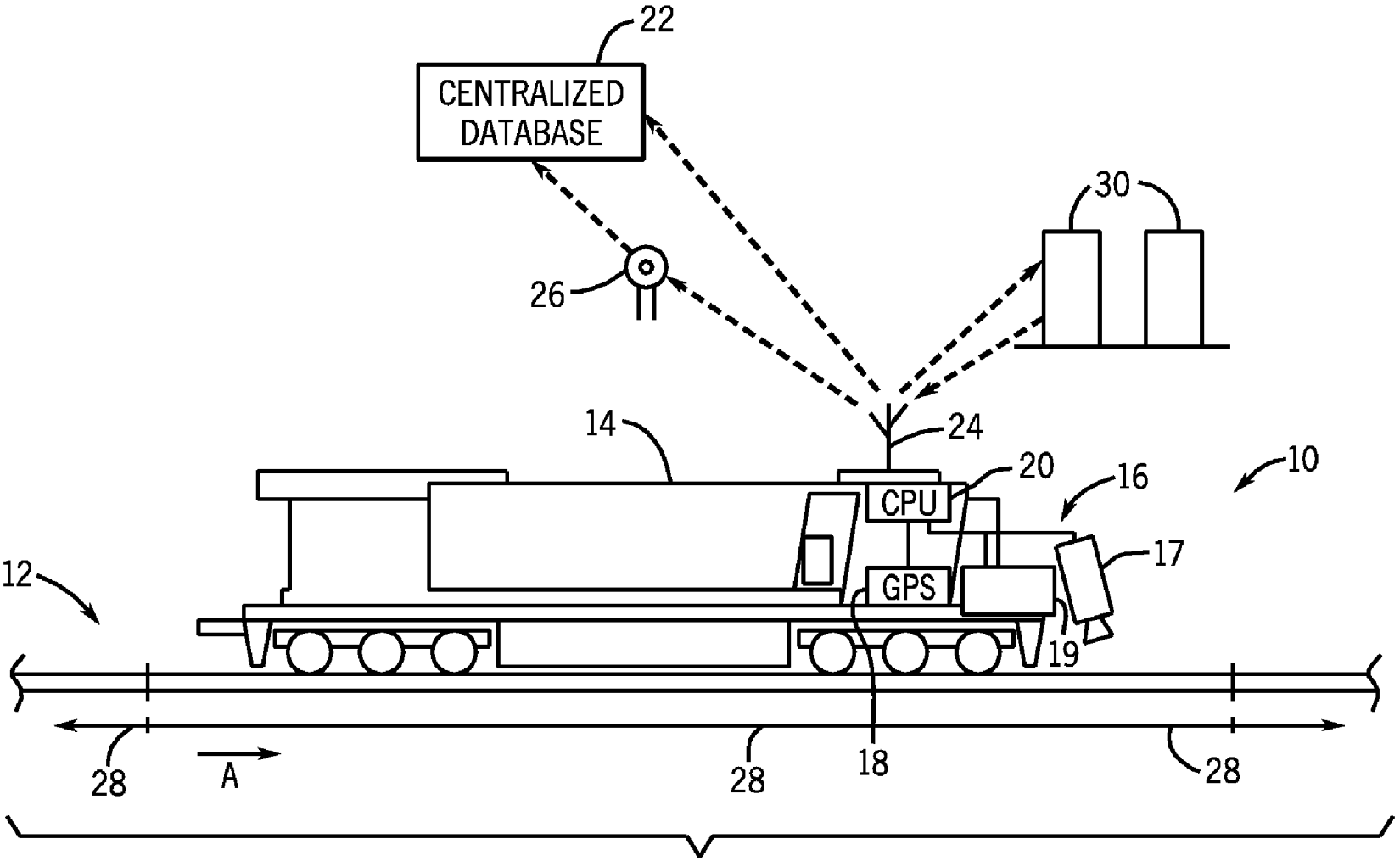
FIG. 1 is a block schematic of a vehicle-centric monitoring system for assessing the condition of a transportation infrastructure according to an embodiment of the invention.

The present disclosure includes embodiments that relate to methods and systems for infrastructure monitoring. The present disclosure includes embodiments that relate to a multi-pass inspection method for infrastructure condition assessment and system optimization.

According to one embodiment of the invention, a monitoring system includes an inspection system mountable on a vehicle that is configured to travel over an expanse of rail track, the rail track having a plurality of track blocks, and the inspection system configured to acquire track data for at least some track blocks along the expanse of rail track. The monitoring system also includes a positioning system mountable on the vehicle and configured to determine a location of the vehicle on the expanse of rail track and generate location data indicative of the track block associated with that vehicle location, a communications device connected to the inspection system and to the positioning system to transmit the track data and the position data to a remote location, and a centralized computing system positioned at the remote location to receive the transmitted track data and location data. The centralized computing system is programmed to determine a current probability of a track condition for a track block based on the track data and combine the current track condition probability for the track block with a previously determined cumulative track condition probability for the track block to provide an updated track condition probability for the track block.

According to one embodiment of the invention, a method includes the steps of acquiring track data and position data during a current pass of a vehicle over an expanse of rail track and transmitting the track data and the position data to a remotely located centralized database. The method also includes the steps of determining a location-indexed track condition of the expanse of rail track at the remotely located centralized database based on the processed track data and the processed position data acquired from the current pass, and combining the determined location-indexed track condition of the expanse of rail track from the current pass with a location-indexed track condition of the expanse of rail track determined from track data and condition data acquired from at least one previous pass of the vehicle over the expanse of rail track to determine an aggregate location-indexed track condition of the expanse of rail track.

According to one embodiment of the invention, a method includes the steps of performing a series of passes of a vehicle over an expanse of track, acquiring track data for a plurality of discrete locations along the expanse of railroad track from the series of passes, and acquiring position data for the plurality of discrete locations along the expanse of railroad track from the series of passes. The method also includes the steps of location-indexing the track data to the discrete locations based on the position data and, during each pass in the series of passes, transmitting the location-indexed track data to a remotely located centralized database. The method further includes the steps of determining at the centralized database, for each pass in the series of passes, a track condition probability for each of the plurality of discrete locations based on the location-indexed track data, combining the track condition probabilities from each pass in the series of passes for each of the plurality of discrete locations to determine a final track condition probability for each of the plurality of discrete locations, and determining a control strategy for a future pass of the vehicle along the expanse of rail track based on the final track condition probability for each of the plurality of discrete locations.

Embodiments of the invention are directed to methods and systems for infrastructure condition monitoring and system optimization. According to one embodiment of the invention, the methods and systems are directed to railway infrastructure monitoring and system optimization. It should be appreciated that a rail track 12 can be a component in many rail systems 10, such as for example, railroad tracks, streetcar tracks, subway tracks, monorail systems and other rail track systems. It should further be appreciated that the operational conditions of the rail track 12 can comprise, for example, conditions that affect the movement of a railcar 14 on the rail track 12, such as imperfections in the rail track. The imperfections in the rail track 12 can comprise undesirable track geometry, cracks, breaks, gaps or other rail track defects.

It is also recognized that methods and systems of the invention can be directed to other forms of transportation infrastructure. For example, the methods and systems can be directed to roadway monitoring and condition assessment. Thus, it is to be understood that the term "rail track" is used for convenience herein and, unless language or context dictates otherwise, includes other stretches of navigable distance, such as roadway, airplane runway, and a drive path in a mining environment.

As shown in FIG. 1, a highly simplified rail system 10 includes a vehicle 14 (e.g., railcar) traveling on a rail track 12 comprised of ties, rails fastened to said ties, and a ballast system embedding said ties. An inspection system 16 is connected to the vehicle 14 and is positioned to acquire data from the rail track 12. Inspection system 16 includes therein one or more inspection devices for acquiring track data from the rail track 12. The track data can be collected continuously or can be sampled at selected instants or locations as the vehicle 14 travels, as will be explained in greater detail below. According to one embodiment, the inspection system 16 can comprise an optical system 17 (e.g., light source and charge coupled device (CCD) camera) configured to rapidly acquire images of the elements of the rail track 12. In one embodiment, the vehicle 14 travels in the direction of arrow A and the optical system 17 acquires images of the rail track 12 ahead of the vehicle 14. In another embodiment, the optical system 17 can be positioned on a rear portion of the railcar 14 and images acquired of the rail track 12 behind the vehicle 14. As such, in this embodiment, the operational condition of the rail track 12 can be determined after the vehicle 14 traveled over that portion of the rail track 12. In yet another embodiment, the optical system 17 can be positioned directly beneath the vehicle 14 and images are acquired of rail track 12 under the vehicle.

An inertial measurement unit (IMU) 19 is also included in the inspection system 16 according to an embodiment of the invention. The IMU 19 includes a combination of inertial sensors, such as one or more accelerometers and one or more gyroscopes (e.g., vertical gyroscope, rate gyroscope), and could also include contact sensors. The IMU 19 acquires velocity/acceleration data based on movement of the vehicle 14. The inertial data/measurements acquired by the IMU 19 can be used to indirectly measure and quantify the geometry of the track. More specifically, and according to one embodiment, gyroscopes in the IMU 19 can acquire data regarding pitch, roll, and yaw information of the vehicle 14, which can be used to determine grade, cross-elevation or cross-level, and track curvature, respectively.

Other inspection devices besides an optical system 17 and/or IMU 19 can also be included in inspection system 16. For example, inspection system 16 can also include a radar transceiver configured to emit wide bandwidth radar signals that elicit radar returned signals that can be processed to indicate imperfections in elements of the rail track 12 (such as ballast and ties), which can be used to determine the operational conditions of the rail track 12. Alternatively, inspection system 16 could include a continuous wave/illumination (CW) laser source and detector combination. The laser output light could be directed/powered to pass through any cracks present in the rail track 12 to impinge on the detector positioned oppositely therefrom or, alternatively, the laser output light could be directed/powered to back-scatter off the rail and onto the detector such that any cracks in the rail can be detected. Inspection system 16 could also be an electromagnetic device utilizing eddy current analysis to indicate flaws in the rail or could be a device employing acoustic (sonic or ultrasonic) energy with appropriate analysis of returned acoustic energy to indicate flaws in the rail. Alternatively, the inspection system could include optical systems such as structured light or LIDAR to measure the track gauge and rail's cross sectional profile. In addition to the inspection devices described above, it is recognized that additional inspection devices could be further implemented in inspection system 16 to further acquire an array of potential measurements.

Also attached to the vehicle 14 is a positioning system 18 configured to track movement of the vehicle 14 and provide positional information as the railcar travels along rail track 12. In one embodiment, the positioning system 18 comprises a global positioning system (GPS) receiver that determines a position of the vehicle 14 in real-time. It is also recognized that aspects of the inspection system 16 can work in conjunction with the positioning system 18 to acquire position data. That is, as the IMU 19 acquires acceleration and angular rate data based on movement of the vehicle 14, data acquired by the IMU can be combined with the positional data provided by the GPS to track movement of the vehicle 14 during operation. It is also envisioned that positioning system 18 could be configured such that the GPS only, or IMU navigation aided by GPS, provides starting position data and that velocity/acceleration data provided by the IMU 19 be used to track movement of the vehicle to determine the vehicle's location over short distances, such as an inspection block. In such an embodiment, pictures acquired by the optical device 17 of inspection system 16 could be used to determine exact positioning of the vehicle 14, by providing a measure of the distance between the rail track 12 and the IMU 19. Alternatively, structured light and/or LIDAR devices in inspection system 16 could be used to locate the rails and determine exact positioning of the vehicle 14 by providing a measure of the distance between the rail track 12 and the IMU 19.

The inspection devices and positioning devices set forth above as being included in the inspection system 16 and positioning system 18 are not meant to be limiting. Additional and/or different inspection devices can be included in the inspection system 16, and the type of track data acquired by those devices can also be varied. Additional and/or different positioning devices can also be included in the positioning system 18, to provide positional information for the vehicle 14.

Referring still to FIG. 1, a processing unit 20 is also included on vehicle 14 and is connected to the inspection system 16 and the positioning system 18, so as to receive track data and positional data therefrom. Processing unit 20 is configured to associate each piece of track data with the positional data to form location dependent track data (i.e., location-indexed track data). That is, the track data acquired via the inspection system 16 (and positioning system 18) is recorded by processing unit 18 as a function of the time/positional data received from the positioning system 18 to provide easy and precise locations of the data acquisitions. According to one embodiment, the processing unit 20 employs standard data logging techniques with, for example, milli- or micro-second time-resolution per measurement, so as to require minimal hard-drive memory allocation. Processing unit 20 is further configured to perform various pre-processing functions on the received data to prepare the data for subsequent transmission to a remotely located centralized database 22, such as at a railroad station or maintenance facility. Thus, according to an embodiment of the invention, processing unit is configured to filter and amplify the acquired track data, so as to put the data in a condition for later analysis thereof. Additionally, the processing unit functions to convert at least a portion of the acquired track data, such as the track data acquired by the IMU 19, into a measured track parameter or track geometry value. For example, track data acquired from inspection system 16 can be pre-processed by processing unit 20 into a corresponding measured track geometry value, such as a track gauge, a track cross-level, a track grade, and a track curvature.

A communications device 24 is included on the vehicle 14 to transmit the measured track geometry values and other track data (e.g., optical images of the rail track) to the centralized database 22. Communications device 24 is positioned on vehicle 14 and connected to the processing unit 20 (and thus further connected to inspection system 16 and positioning system 18) to receive an input therefrom in the form of location-indexed measured track geometry values and/or track data. According to one embodiment, communications device 24 comprises, for example, an antenna configured to transmit radio frequency (RF) therefrom to centralized database 22. Communication to the centralized database 22 from the vehicle 14, however, can be through any number of wireless communication schemes. That is, data can be transmitted directly or through periodic wayside control points 26 (i.e., relayed to the centralized database by the wayside control points). It is also envisioned that communications device 24 could also utilize other forms of data transfer for communicating the track data and location data to centralized database 22. For example, ethernet, wi-fi, Bluetooth, and other similar platforms could also be implemented as the desired form of communication.

According to one embodiment of the invention, communications device 24 comprises a transceiver configured to both transmit and receive data. That is, in addition to transmitting track data and location data to a remotely located centralized database 22, communications device 24 is also configured to receive signals from infrastructure signaling devices 30 adjacent to the rail track 12 and forming part of the railway infrastructure, as the vehicle 14 travels along the rail track 12. Lubrication equipment, switches, and fixed wireless devices, for example, can transmit infrastructure condition signals via wireless transmission to the communications device 24 to provide an operator of the vehicle 14 with operative instructions or expected track conditions (i.e., lubrication strategies, etc.). In addition to receiving signals, the wireless communication between the vehicle 14 and the infrastructure signaling devices can be bidirectional such that, for example, communications device 24 transmits downloadable device settings and firmware updates (i.e., infrastructure update signals) to the infrastructure signaling devices 30 when desired, thus allowing for convenient updating of the infrastructure signaling devices. Furthermore, it is recognized that communications device 24 could receive signals (i.e., trip data) from other remote locations, such as from the centralized database 22, which can contain information related to weather, earthquakes, and/or traffic congestion on the expanse of rail track 12.

As set forth above, communications device 24 is included on the vehicle 14 to transmit the measured track geometry values and other track data (e.g., optical images of the rail track) to the centralized database 22. According to an exemplary embodiment, and in order to reduce the amount of pre-processing needed on the vehicle and reduce the amount of data transmitted by communications device, the acquired track data is processed for a plurality of pre-determined track blocks 28 (i.e., discrete locations) within the expanse of rail track 12. That is, rather than continuously processing/transmitting track data as it is acquired by inspection system 16, the track data is periodically analyzed/processed for each of a plurality of independent track blocks 28 that are defined within the expanse of rail track 12. For example, before a pass of the vehicle 14 commences over the expanse of rail track 12, an operator can input a setting into the processing unit 20 to define the length of a track block 28, such as every 100 feet of rail track. As the vehicle 14 traverses the expanse of rail track 12, track data acquired from every 100 ft (for example) of rail track 12, corresponding to each rail block 28, is pre-processed by the processing unit 20, and subsequently transmitted to the centralized database 22. According to one embodiment, a measured rail geometry value, such as track gauge, track cross-level, track grade, and/or track curvature, would be determined for each track block 28 based on the track data acquired and pre-processed by processing unit 20.

Figure 2:
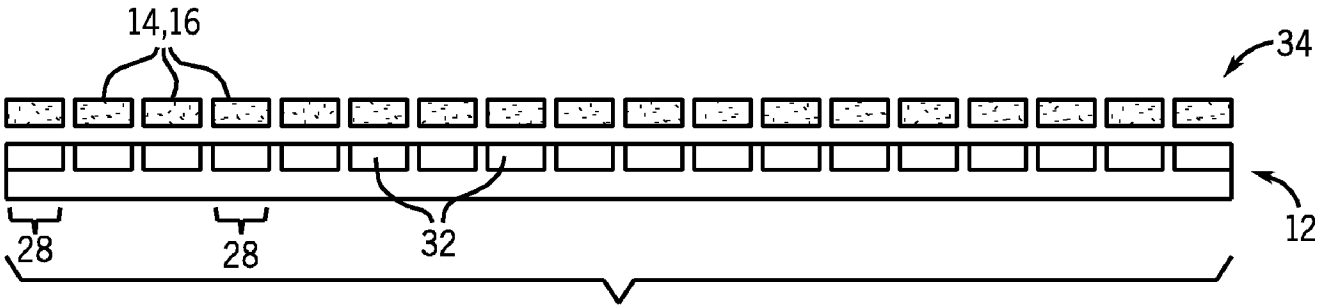
FIG. 2 is a block diagram of an inspection pattern for an expanse of transportation infrastructure according to an embodiment of the invention.

Referring now to FIG. 2, according to one embodiment of the invention, inspection system 16 is configured and controlled to sequentially and continuously acquire track data 32 as vehicle 14 travels along rail track 12, according to a continuous data acquisition mode 34. That is, inspection system 16 is operated in the continuous data acquisition mode 34 so as to acquire track data 32 for each track block 28 (i.e., discrete location) defined along the expanse of rail track 12. Track data 32 for each track block 28 defined along the expanse of rail track 12 is thus acquired during a single pass of the vehicle 14 thereover.

Figure 3:
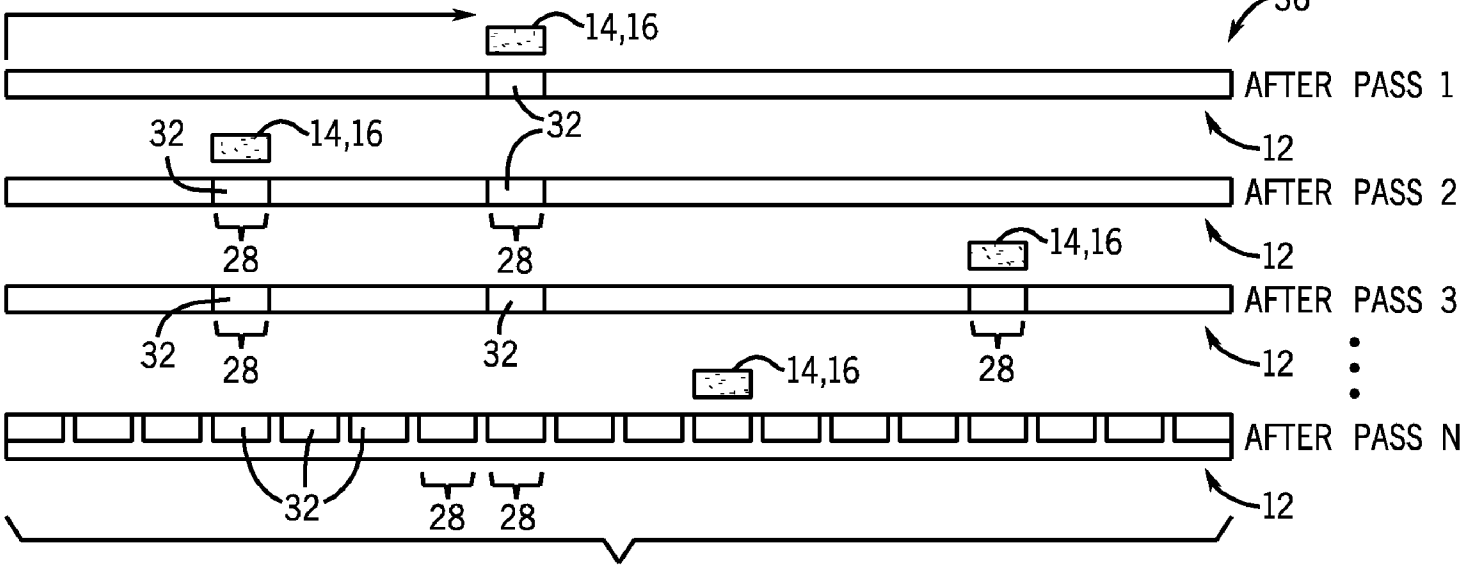
FIG. 3 is a block diagram of an inspection pattern for an expanse of transportation infrastructure according to another embodiment of the invention.

According to another embodiment of the invention, and as shown in FIG. 3, inspection system 16 is configured and controlled to acquire track data on a periodic (or random) basis as vehicle 14 travels along rail track 12, according to a periodic data acquisition mode 36. That is, inspection system 16 is operated in the periodic data acquisition mode 36 so as to acquire track data for selected track blocks 28 (i.e., selected discrete points) along the expanse of rail track 12. In such an embodiment, a smaller amount of track data is acquired by inspection system 16 during a pass of vehicle 14 over the expanse of rail track 12, and thus, less track data is required to be pre-processed and transmitted to the centralized database 22 (FIG. 1), as may be required by lower bandwidth communication systems. As track data is acquired for only a portion of the rail track 12 (i.e., selected track blocks 28) during a single pass of rail car thereover, it is recognized that multiple passes by the vehicle 14 over the rail way 12 are needed to acquire track data for the entire expanse of rail track 12 and to form an accurate assessment of the rail condition. As shown in FIG. 3, after a number N of passes by the vehicle 14 over the expanse of rail track 12, track data is acquired for each track block 28 in the expanse of rail track 12. While shown as performing only a single acquisition of track data for each track block 28 in the expanse of rail track 12 during the multiple passes by vehicle 14, it is envisioned that inspection system 16 could also perform multiple acquisitions of track data for a track block 28 in the expanse of rail track 12 during the periodic/random track data acquisition performed during the multiple passes.

As described above with respect to FIG. 1, track data and positional data acquired by the inspection system 16 and positional system 18, along with measured track geometry values determined by pre-processor 20 are transmitted to the remotely located centralized database 22 via communications device 24. Upon reception at the centralized database 22, the transmitted data is used to determine a location-indexed condition of the rail track 12. The centralized database is programmed to analyze the location-stamped track data to determine calculated track geometry values for each of the plurality of track blocks 28 in the expanse of rail track 12 and to determine the probability of a track condition in the track blocks. That is, from the track data acquired by inspection system 16, and based on the measured track geometry values (track gauge, cross-level, grade, and curvature) determined by processing unit 20, additional track geometry parameters can also be calculated. The centralized database 22 is programmed to determine, from the measured track geometry values, calculated track geometry values such as track alignment, track warp, track profile, track run-off and track quality indices, and rail profile and wear.

Figure 4:
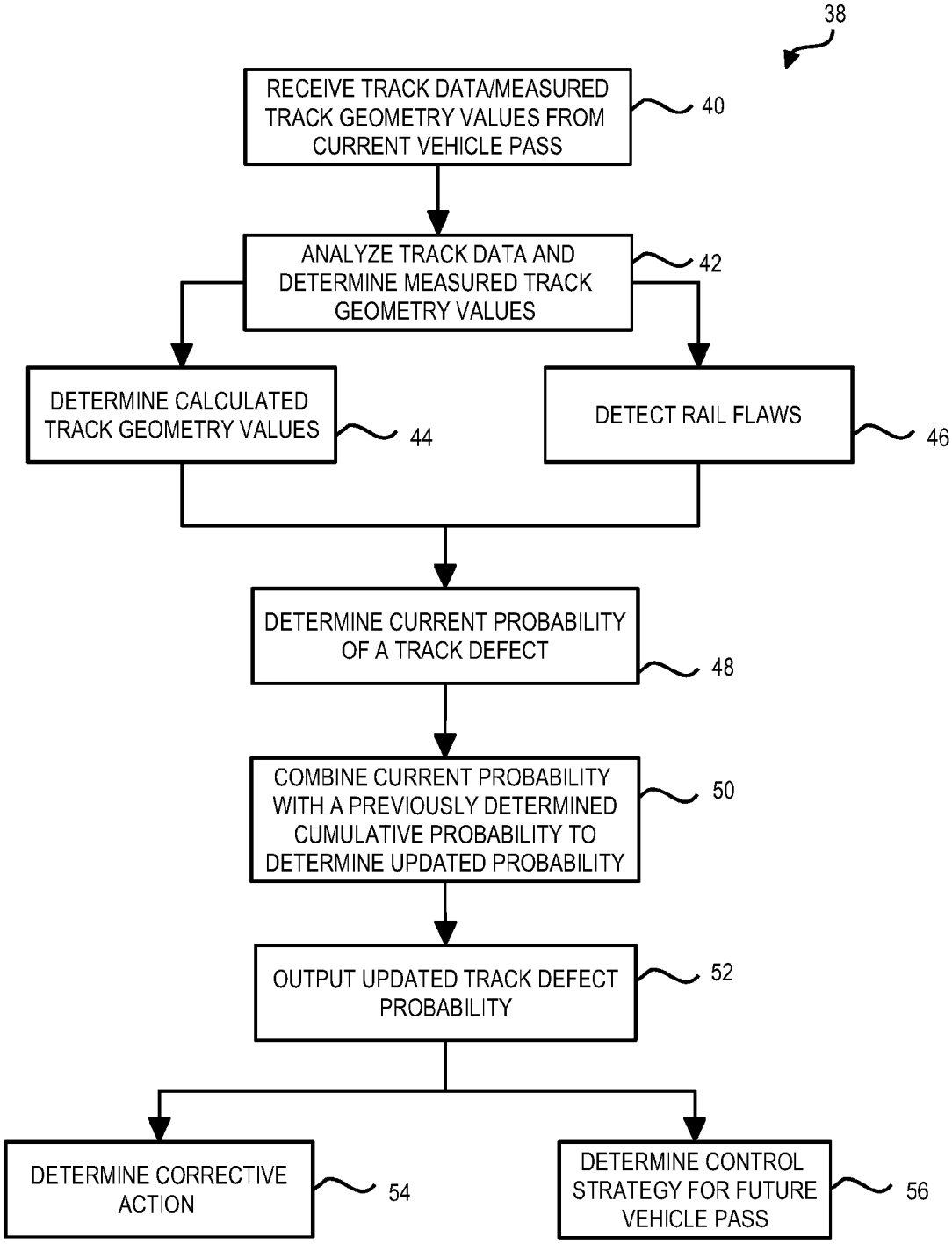
FIG. 4 is a flow diagram illustrating a technique for analyzing acquired infrastructure data to determine the probability of a defect in an expanse of transportation infrastructure according to another embodiment of the invention.

Referring now FIG. 4, a flow chart is shown displaying a computer implemented process or technique 38 performed by the centralized database 22 to analyze the track data and measured track geometry values, determine calculated track geometry values, and determine the probability of a track condition in each of the track blocks included in the expanse of rail track. The technique begins at STEP 40 with the reception of track data and measured track geometry values at the centralized database acquired during a current pass of the vehicle along the expanse of rail track. The track data and measured track geometry values are transmitted to the centralized database from the communications device located on the vehicle and are transmitted as the vehicle travels along the expanse of rail track.

At STEP 42, the centralized database analyzes the received track data and measured track geometry values from the current pass to obtain a more detailed assessment of a condition of the expanse of rail track, and of each track block therein. From the analysis of the track data and measured track geometry values, the centralized database is programmed to determine calculated track geometry values at STEP 44. That is, centralized database combines a number of the measured track geometry values to determine a plurality of calculated track geometry values. Track geometry parameters such as track alignment, track warp, track profile, track run-off and track quality indices, and rail profile and wear, can be determined by analysis of the measured track geometry values of track gauge, cross-level, grade, and curvature.

In addition to track geometry, imperfections in the rail track can be detected by analyzing of the track data. That is, from the analysis of the track data and measured track geometry values, the centralized database is further programmed to detect rail flaws at STEP 46. For example, centralized database can be programmed to detect internal and external rail flaws such cracked rails, spalled rails, and shelled rails based on images of the rail track obtained by an optical device included in the inspection system. Images/data regarding the rail-ties and ballast can be examined to characterize and trend degradation and flaws therein. According to one embodiment of the invention, rail track surface cracks/fissures are isolated from the bulk track surface by use of machine vision software (MVS) programmed into the centralized database. For example, an image acquired by the inspection system can be scanned for darker areas that stand out from the bulk image, and those darker areas can then be isolated. Knowing the geometric arrangement of the inspection device (e.g., camera viewing area) allows the centralized database to measure accurately the dimensions of the cracks. Other techniques could, of course, be used as appropriate.

Upon a determination of the calculated track geometry values and of the detection of any rail flaws, the centralized database is programmed to determine the current probability of a track condition for a track block in the expanse of rail track at STEP 48. The track condition provides an overall assessment of the physical characteristics of the rail track (e.g., track geometry values) and also includes the identification of track defects, which can include any one of a plurality of what are determined to be unacceptable parameters of the rail track. Thus, for example, a track defect can include a measured track geometry value outside of a pre-determined threshold, a calculated track geometry value outside of a pre-determined threshold, and a detected track flaw. Thus, unacceptable measured track geometry values of track gauge, cross-level, grade, and/or curvature can be considered to be a track defect. Similarly, unacceptable calculated track geometry values of track alignment, warp, profile, track run-off, and/or rail profile and wear can also be considered to be a track defect. Furthermore, internal and external rail flaws such rail cracks, spalls, or shelling beyond a pre-determined acceptable size/amount, can also be considered to be a track defect.

According to one embodiment of the invention, the determination of a current probability of a track condition for a given block of track at STEP 48 is calculated using by way of a detection and isolation algorithm included in the centralized database that implements an innovation calculator and a hypothesis tester. The track data, measured track geometry values, calculated track geometry values, and detected rail flaws are input into the innovation calculator, which outputs an innovation sequence in response thereto. The innovation sequence is input into the hypothesis tester, which utilizes a multiple hypothesis statistical test to detect and isolate track conditions. Specifically, the hypothesis tester uses a Bayesian likelihood ratio test to select the hypothesis most likely to be true given the current value of the innovation sequence. The hypothesis tester first averages the innovations using a window (with a size of about 1 second), and uses the result to perform a multiple hypothesis test. A set of preferred hypotheses is selected and a test statistic determined for each hypothesis. The algorithm selects the hypothesis having the largest test statistic value, which is determined to be the best determiner of a track defect probability. Such a hypothesis test is explained in greater detail in commonly owned U.S. Pat. No. 6,526,358 to Mathews, Jr. et al. It is recognized that other statistical analysis techniques besides that described above can also be implemented by the centralized database to determine a current track condition probability.

Upon determination of the current track condition probability for a track block, the current track condition probability for the track block is combined with a previously determined cumulative track condition probability for the track block at STEP 50 to provide an updated (i.e., aggregate) track condition probability for the track block. That is, the current track condition probability for the track block determined at STEP 48 is aggregated with a cumulative track condition probability formed from a plurality of previously determined track condition probabilities resulting from a series of previous passes of a vehicle over the expanse of rail track. According to one embodiment of the invention, the current track condition probability and the plurality of previously determined track condition probabilities (forming the cumulative track condition probability) are aggregated and fused using Bayes rule into an updated/final track condition probability for a track block. That is, the determination of a track condition probability may be characterized by Bayesian probability theory wherein the initial probability of the track condition is based on the current track data. The probability is modified using Bayes rule, with the initial track condition probability determined from the current track data being applied to and combined with track condition probabilities ascertained from previously acquired track data (i.e., previous vehicle passes/data acquisitions), to output a final track condition probability that is the combination of probabilities of a track condition based on the combination of vehicle passes. The combination of probabilities is output as the updated/final track condition probability at STEP 52. While Bayes rule is set forth above for aggregating and fusing track condition probabilities, other statistical analysis techniques could also be implemented.

Based on the output of an updated/final track condition probability, the centralized database is programmed to analyze the updated/final track condition probability to determine condition probability trends and/or an unacceptably high probability of a track defect, as determined from the track condition. The centralized database can compare the most recent (or the several most recent) updated/final track condition probability to previously determined updated/final track condition probabilities to detect a trending of the track condition probability toward an undesirable level (i.e., an increasing probability of a track defect). Such trending of track defect probability values can be assessed by the centralized database, and if the trending exceeds a pre-determined acceptable level, a corrective action can be suggested/output by the database, as described below.

It is recognized that the track condition probability determined by the centralized database can be performed for selected track blocks within the expanse of rail track, or for each and every track block within the expanse of rail track. The determination of a track condition probability for selected blocks is based on the track data acquisition technique set forth above with respect to FIGS. 2 and 3. A current track condition probability for a track block is determined by the centralized database only when track data from that track block is acquired from a current pass of a vehicle along the expanse of rail track. It is also recognized that the centralized database can determine a track condition probability for a plurality of track characteristics, such as for each type of track defect that may be present in the rail track. That is, a track condition probability can be determined for any one of a number of measured track geometry values for a track block, and a separate track condition probability can be determined for any one of a number of calculated track geometry values for that same track block.

Referring still to FIG. 4, according to one embodiment of the invention, the centralized database is further programmed to determine a corrective action based on the updated/final track condition probability at STEP 54. That is, if the updated/final track condition probability (e.g., a track defect probability) is determined to be above an acceptable limit or have an unacceptable trending, the centralized database can determine a corrective action to be taken by an operator to address a defect in the rail track. Such a corrective action could include outputting a suggested maintenance plan for one or more track blocks, outputting track lubrication strategies, and/or outputting grinding strategies to optimize rail profile. The suggested maintenance plan can be in the form of scheduled maintenance to be performed on the track on a periodic basis, or in the form of unplanned maintenance to be performed on the track in order to correct undesirable track conditions. Track geometry, such as track gauge, track cross-level, track grade, track curvature, track alignment, track warp, track profile, track run-off and track quality indices, and rail profile and wear, can be modified to optimize conditions for passage of a vehicle thereover.

Additionally, and according to one embodiment of the invention, the centralized database is further programmed to determine a control strategy for future passes of a vehicle along the expanse of rail track at STEP 56. Specifically, optimal train control characteristics can be determined for the expanse of rail track based on for example rail wear, curving train resistance, and geometry considerations. A train handling strategy can also be determined to maximize fuel economy and rail track life. Such infrastructure-optimal control strategies can be transmitted from the centralized database to a vehicle prior to departure and its pass along the expanse of rail track. It is recognized that the characterization of rail geometry and conditions provided by the centralized database analysis of the track data can be used to optimize other railroad functions beyond those set forth above to maximize capacity and efficiency, and minimize life cycle costs.

Beneficially, the track data acquisition from multiple pass over an expanse of rail track, and the incremental updating of a track condition probability provided by these multiple sets of acquired track data, provides an operator with up-to-date information/data on a condition of the expanse of railroad track, and of the track blocks therein. As each set of track data that is acquired via a single pass thereover by a vehicle is transmitted to and processed/analyzed at the centralized database, the centralized database of location-indexed infrastructure condition is thus built-up from the passage of many vehicles and is analyzed to provide a more accurate determination of the rail track/infrastructure condition. The collection of track data over multiple passes, and the combining of that data, provides for a continuous (or nearly continuous) distribution of various track parameters (i.e., track geometry values) and of track condition probabilities.

It is recognized that the greater the number of passes made by vehicles over the expanse of rail track, the greater the confidence and/or accuracy of the detection of a track condition and of track defects. For example, assuming a uniform distribution of instrumented vehicles and depending on the size of the segments, a number of passes of between 40 and 80 would result in a confidence of 95% that each of the segments in a section have been sampled, whereas a lesser number of passes would result in a lower confidence value. Beneficially, an expanse of rail track that is more heavily used thus receives more inspection time, whereas rail track that is less heavily used receives proportionally less inspection time, thus providing a self-normalizing feature. Track that is less heavily used, however, still receives adequate inspection trend data according to the above described system and method.

The invention has been described in terms of the preferred embodiments, and it is recognized that equivalents, alternatives, and modifications, aside from those expressly stated, are possible and within the scope of the appending claims.

What is claimed is:

1. A monitoring system, comprising:

an inspection system mountable on a vehicle that is configured to travel over an expanse of rail track, the rail track having a plurality of track blocks, and the inspection system configured to acquire track data for at least some track blocks along the expanse of rail track;

a positioning system mountable on the vehicle and configured to determine a location of the vehicle on the expanse of rail track and generate location data indicative of the track block associated with that vehicle location;

a communications device connected to the inspection system and to the positioning system to transmit the track data and the location data to a remote location; and a centralized computing system positioned at the remote location to receive the transmitted track data and location data, the centralized computing system programmed to:

determine a current probability of a track condition for a track block based on the track data; and combine the current track condition probability for the track block with a previously determined cumulative track condition probability for the track block to provide an updated track condition probability for the track block.

2. The monitoring system of claim 1, wherein the centralized computing system is further programmed to:

aggregate the current track condition probability for at least some of the plurality of track blocks with the previously determined track condition probabilities; and fuse the aggregated track condition probabilities to determine the updated track condition probability for at least some of the plurality of track blocks.

3. The monitoring system of claim 1, wherein the communications device is further configured to receive infrastructure condition signals from trackside infrastructure.

4. The monitoring system of claim 3, wherein the communications device is further configured to transmit infrastructure update signals to the trackside infrastructure.

5. The monitoring system of claim 1, wherein the communications device is further configured to receive trip data from a remote location, the trip data comprising at least one of weather data, seismic data, and traffic congestion data.

6. The monitoring system of claim 1, further comprising a processing unit positioned onboard the vehicle and connected to the inspection system and to the positioning system to receive the track data and the location data therefrom, the processing unit programmed to:

analyze the track data acquired for a track block in the plurality of track blocks;

determine at least one measured track geometry value for the track block from the analyzed track data.

7. The monitoring system of claim 6, wherein the at least one measured track geometry value comprises one of a track gauge, a track cross-level, a track grade, and a track curvature.

8. The monitoring system of claim 6, wherein the centralized computing system is further programmed to determine calculated track geometry values from the at least one measured track geometry value, the calculated track geometry values comprising at least one of a track alignment, a track warp, a track profile, and a track run-off.

9. The monitoring system of claim 1, wherein the track condition comprises a track defect comprising one of a measured track geometry value outside of a pre-determined threshold; a calculated track geometry value outside of a pre-determined threshold; and a track flaw, the track flaw comprising one of a cracked rail, spalled rail, and shelled rail.

10. The monitoring system of claim 1, wherein the centralized computing system is further programmed to:

determine a vehicle operation parameter based on at least one of the track data and the track condition; and wirelessly transmit the vehicle operation parameter to the vehicle.

11. The monitoring system of claim 1, wherein the inspection system comprises an optical system configured to acquire images of the rail track.

12. The monitoring system of claim 1, wherein the positioning system comprises an inertial navigation system including an inertial measurement unit and a global positioning system (GPS).

13. The monitoring system of claim 1, wherein the centralized computing system is further programmed to compare the updated track condition probability to previously determined updated track condition probabilities to determine a track condition probability trend.

14. A method, comprising:

acquiring track data and position data, with, respectively, an inspection system and a positioning system, during a current pass of a vehicle over an expanse of rail track;

transmitting the track data and the position data to a remotely located centralized computing system;

determining a location-indexed track condition of the expanse of rail track at the remotely located centralized computing system based on the processed track data and the processed position data acquired from the current pass; and combining the determined location-indexed track condition of the expanse of rail track from the current pass with a location-indexed track condition of the expanse of rail track determined from track data and condition data acquired from at least one previous pass of the vehicle over the expanse of rail track to determine an aggregate location-indexed track condition of the expanse of rail track.

15. The method of claim 14, wherein acquiring track data comprises acquiring track data for a plurality of pre-determined track sections within the expanse of rail track.

16. The method of claim 15, further comprising:

processing at least a portion of the track data onboard the vehicle to determine at least one measured track parameter value for each of the plurality of track sections; and transmitting the at least one measured track parameter value to the remotely located centralized computing system.

17. The method of claim 15, wherein determining a location-indexed track condition of the expanse of rail track comprises determining a probability of a track defect in each of the plurality of track sections.

18. The method of claim 17, wherein determining an aggregate location-indexed track condition of the expanse of rail track comprises:

aggregating the track defect probabilities from the current pass and from each of the at least one previous passes for each of the plurality of track sections; and fusing the aggregate defect probabilities for each of the plurality of track sections into a final defect probability.

19. The method of claim 17, wherein fusing the probabilities comprises applying Bayes rule to the aggregated track defect probabilities.

20. The method of claim 14, further comprising determining a control strategy for the vehicle for traveling along the expanse of rail track based on the aggregate location-indexed track condition of the expanse of rail track.

21. A method, comprising:

performing a series of passes of a vehicle over an expanse of track;

acquiring track data, with an inspection system, for a plurality of discrete locations along the expanse of railroad track from the series of passes;

acquiring position data, with a positioning system, for the plurality of discrete locations along the expanse of railroad track from the series of passes;

location-indexing the track data to the discrete locations based on the position data;

during each pass in the series of passes, transmitting the location-indexed track data to a remotely located centralized computing system;

determining at the centralized computing system, for each pass in the series of passes, a track condition probability for each of the plurality of discrete locations based on the location-indexed track data;

combining the track condition probabilities from each pass in the series of passes for each of the plurality of discrete locations to determine a final track condition probability for each of the plurality of discrete locations; and determining a control strategy for a future pass of the vehicle along the expanse of rail track based on the final track condition probability for each of the plurality of discrete locations.

22. The method of claim 21, wherein combining the track condition probabilities comprises:

aggregating the track condition probabilities from the series of passes for each of the plurality of discrete locations; and fusing the aggregate condition probabilities for each of the plurality of discrete locations into a final condition probability.

23. The method of claim 21, further comprising:

processing at least a portion of the track data onboard the vehicle to determine at least one measured track parameter value for each of the plurality of discrete locations; and transmitting the at least one measured track parameter value to the remotely located centralized computing system.

24. The method of claim 23, further comprising determining at the centralized computing system, for each pass in the series of passes, a calculated track parameter value for each of the plurality of discrete locations based on the at least one measured track parameter value.

25. The method of claim 21, further comprising:

receiving infrastructure condition signals at the vehicle from trackside infrastructure as the vehicle travels along the expanse of railroad track; and transmitting service data from the vehicle to the trackside infrastructure as the vehicle travels along the expanse of railroad track.

* * * * *